United States Patent [19]

Nagai et al.

[11] 4,424,507

[45] Jan. 3, 1984

[54] THIN FILM THERMISTOR

[75] Inventors: Takeshi Nagai; Kazushi Yamamoto; Ikuo Kobayashi, all of Nara, Japan

[73] Assignee: Matsushita Electric Industrial Co., Ltd., Osaka, Japan

[21] Appl. No.: 363,498

[22] Filed: Mar. 30, 1982

[30] Foreign Application Priority Data

Apr. 10, 1981 [JP] Japan ..... 56/54892
Dec. 15, 1981 [JP] Japan ..... 56/202731

[51] Int. Cl.[3] ..... H01C 7/04
[52] U.S. Cl. ..... 338/22 R; 338/28
[58] Field of Search ..... 338/22 R, 22 SD, 25, 338/23, 24, 28, 308, 309; 374/185, 208

[56] References Cited

U.S. PATENT DOCUMENTS

| | | | |
|---|---|---|---|
| 3,430,336 | 3/1969 | Riddel | 338/22 R X |
| 3,442,014 | 5/1969 | Lopacki | 338/22 R X |
| 3,472,074 | 10/1969 | Glang et al. | 338/25 X |
| 3,868,620 | 2/1975 | McBride, Jr. et al. | 338/28 |
| 4,242,659 | 12/1980 | Baxter et al. | 338/28 |

*Primary Examiner*—C. L. Albritton
*Attorney, Agent, or Firm*—Wenderoth, Lind & Ponack

[57] ABSTRACT

A thin film thermistor having a thermistor element, one pair of external leads and a metal housing is arranged such that the thermistor element is secured to the inner surface thereof by brazing. The thin film thermistor rapidly detects temperatures by means of a mechanical connection between the thermistor and an outer surface of an object that it touches. The thermistor element may be covered with a protective layer of a fired low melting point glass in order to protect the thermistor element from a severe environment.

13 Claims, 4 Drawing Figures

THIN FILM THERMISTOR

BACKGROUND OF THE INVENTION

1. Field of the Invention

The present invention relates to a temperature sensing device and in particular to a rapid response thin film thermistor used for detecting a temperature by means of a mechanical connection between the thermistor and an outer surface of an object that it touches. For example, this type of temperature sensing device is used when the temperature of cooking materials in a pan must be detected for the purpose of controlling automatic cooking, wherein the temperature is detected by means of a mechanical connection of the device to an outer bottom surface of the pan.

2. Description of the Prior Art

One type of temperature sensing device is a thermocouple such as a chromel-alumel thermocouple, which is welded on an inner closed end surface of a metal housing having a bore extending along the longitudinal axis thereof, said device having a closed end and an open end. A temperature is detected by means of a mechanical connection of the outer closed end surface of the metal housing to an outer surface of an object that it touches. The thermocouple has a desirable rapid thermal response and a superior thermal stability. However, the thermocouple has the disadvantages of a low temperature sensitivity and a requirement of an electric circuit for compensating for the influence of the atmospheric temperature on the temperature detection.

Another type of temperature sensing device is a small thermistor, such as a bead-type thermistor comprising oxide mixtures of metals such as Fe, Ni, Co, Mn and the like. The thermistor is attached to the inner closed end surface of the metal housing described above. A temperature is detected by means of the same mechanical connection as that of the thermocouple. The thermistor has a desirable high temperature sensitivity and does not require an electric circuit for compensating for the influence of the atmospheric temperature on the temperature detection. However, the thermistor has the disadvantage of a slow thermal response because of a high contact heat resistance between the bead-type thermistor and the inner closed end surface. Since the bead-type thermistor has the form of a sphere, an ellipsoid or the like, it is difficult to obtain a low contact heat resistance when the bead-type thermistor is attached to the flat surface.

SUMMARY OF THE INVENTION

An object of this invention is to provide a thin film thermistor which can detect a temperature by means of a mechanical connection thereof to an outer surface of an object that it touches.

Another object of the present invention is to provide a thin film thermistor which has a rapid thermal response and high reliability.

A further object of the present invention is to provide a thin film thermistor which can detect a temperature over a wide range.

Still another object of the present invention is to provide a thin film thermistor which can be protected from severe environments contaminated by humidity and organic vapors such as of oils, and the like, thus ensuring a high reliability of operation under such severe conditions.

According to one aspect of the present invention, there is provided a thin flim thermistor comprising an insulating substrate, one pair of electroconductive electrodes on one surface of the insulating substrate arranged in a desired pattern, the electrodes being electrically insulated from each other, a thermally sensitive resistive film arranged on the one surface of the insulating substrate and at least one pair of the electroconductive electrodes, said film arranged so as to leave part of the electrodes exposed for making external connections thereto, one pair of external leads connected to the exposed electrode portions, and a metal housing in a cylindrical form having a bore extending along the longitudinal axis thereof and having both a closed end and an open end, wherein another surface of the insulating substrate is secured to the inner surface of the closed end by a brazing arrangement of an Ag-Cu alloy layer, a Ti or Zr foil layer, and another Ag-Cu alloy layer, said layers arranged between said another surface of the insulating substrate and the inner surface of the closed end.

By means of a mechanical connection of the outer surface of the closed end of the thin film thermistor with an outer surface of an object that is touches, the temperature of the object can be detected. Because of a low heat resistance between the thermally sensitive resistive film and the outer surface of the closed end, the thermistor can detect the temperature very rapidly.

According to another aspect of the present invention, one entire surface of the insulating substrate whereon the electrodes and thermally sensitive resistive film are formed, is covered with a protective layer of a fired low melting point glass. By this arrangement, the thermistor can be satisfactorily protected from a hostile environment.

DESCRIPTION OF THE PREFERRED EMBODIMENTS

Figure 1:
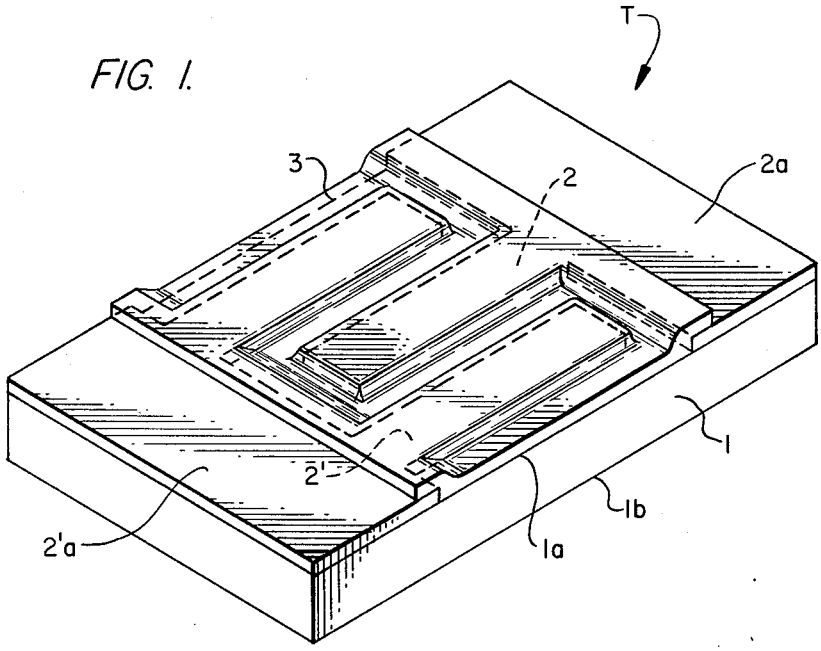
FIG. 1 is a schematic view of a thermistor element comprising an insulating substrate, and electroconductive electrodes and a thermally sensitive resistive film formed on one surface of the insulating substrate.

Referring now to FIG. 1, there is shown a thermistor element generally indicated by T. The thermistor element T includes an insulating substrate 1, whereof on one surface 1*a* are formed electrode films 2, 2' and a thermally sensitive resistive film 3 in this order in such a way that portions 2*a*, 2'*a* of the electrode films 2, 2' are exposed for external connections. The electrode films 2, 2' are formed in such a pattern as shown in FIG. 1. The resistance of the element T depends on the specific resistance and thickness of the resistive film 3 and the pattern form of the electrode films 2, 2'. An alumina ceramic is usually used as the insulating substrate 1. Needless to say, any insulating materials which are stable above 800° C., other than an alumina ceramic, may be used in the practice of the invention. Electroconductive thick films such as Ag, Au, Au-Pd, Ag-Pd, Pt or Au-Pt, formed by a firing technique, or electroconductive films such as Ag, Au or Cu, formed by a vacuum deposition or sputtering technique, are used as electrode films 2, 2'. Thermally sensitive films such as Si, Ge, SiC or oxide mixtures of metals such as Fe, Ni, Co, Mn and the like, formed by a vacuum deposition, sputtering or the like technique are used as the thermally sensitive film 3.

Figure 2:
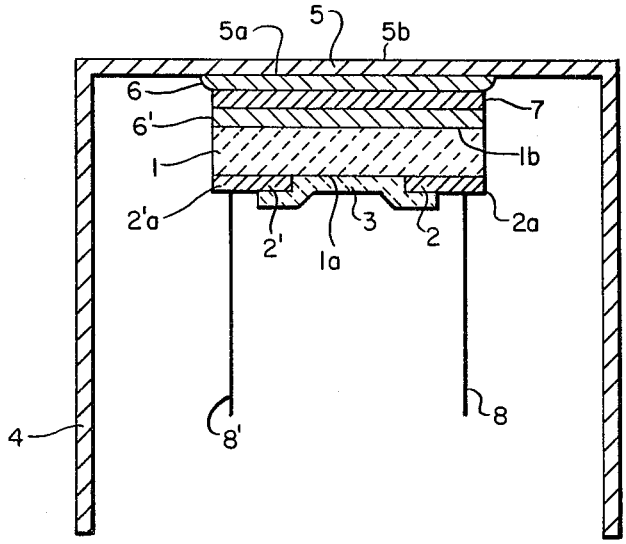
FIG. 2 is a cross-sectional view showing a construction of a thin film thermistor according to the present invention.

Referring to FIG. 2, there is shown a construction of a thin film thermistor according to the invention. One of important features of the invention resides in a novel construction and the construction will be particularly described by the following experimental example.

In the first step of constructing the thin film thermistor of FIG. 2, there is provided a thermistor element T comprising an alumina substrate 1 (1.8 mm×6.5 mm×0.5 mm), whereof on one surface 1*a* are formed fired Au-Pt electrode films 2, 2' of about 15 μm in thickness and a sputtered SiC resistive film 3 of about 2 μm in thickness. On the other hand, a metal housing 4 is provided, said housing being in a cylindrical form and having a bore extending along the longitudinal axis thereof, and having both a closed end and an open end. The metal housing 4 is composed of a Fe-Cr alloy of 0.4 mm in thickness and in the cylindrical form of about 14 mm in diameter.

The other surface 1*b* of the alumina substrate 1 is then secured to the inner surface 5*a* of the closed end 5 of the metal housing 4 by a brazing arrangement of an Ag-Cu alloy layer 6, a Ti or Zr foil layer 7 and a Ag-Cu alloy layer 6', said layers arranged between another surface 1*b* of the alumina substrate 1 and the inner surface 5*a* of the closed end 5. This construction according to the invention is easily obtained by means of heating in an inert atmosphere a piled mass in the order of the thermistor element T including the alumina substrate 1, the Ag-Cu alloy layer 6', the Ti or Zr foil layer 7, the Ag-Cu alloy layer 6 and the metal housing 4. In this experiment, a Ag-Cu eutectic alloy (Ag 73–71 wt%, Cu 27–29 wt%) foil of about 20 μm in thickness and a Ti foil of about 20 μm in thickness were used as the Ag-Cu alloy 6, 6' and the Ti or Zr foil 7, respectively. The piled mass was heated at 820° C. for a few minutes in a vacuum. Thus, the construction according to the present invention was obtained.

One pair of Pt, for example (0.15 mm in diameter) external leads 8, 8' is then welded to the exposed portions 2*a*, 2'*a* of the electrode films 2, 2'.

When the outer surface 5*b* of the closed end 5 of the thus constructed thin film thermistor is mechanically connected to an outer surface of an object that it touches, the resistance of the thermally sensitive film 3 varies in accordance with the temperature of the object. This fact indicates that the thin film thermistor according to the present invention can detect the temperature by means of the mechanical connection.

Figure 3:
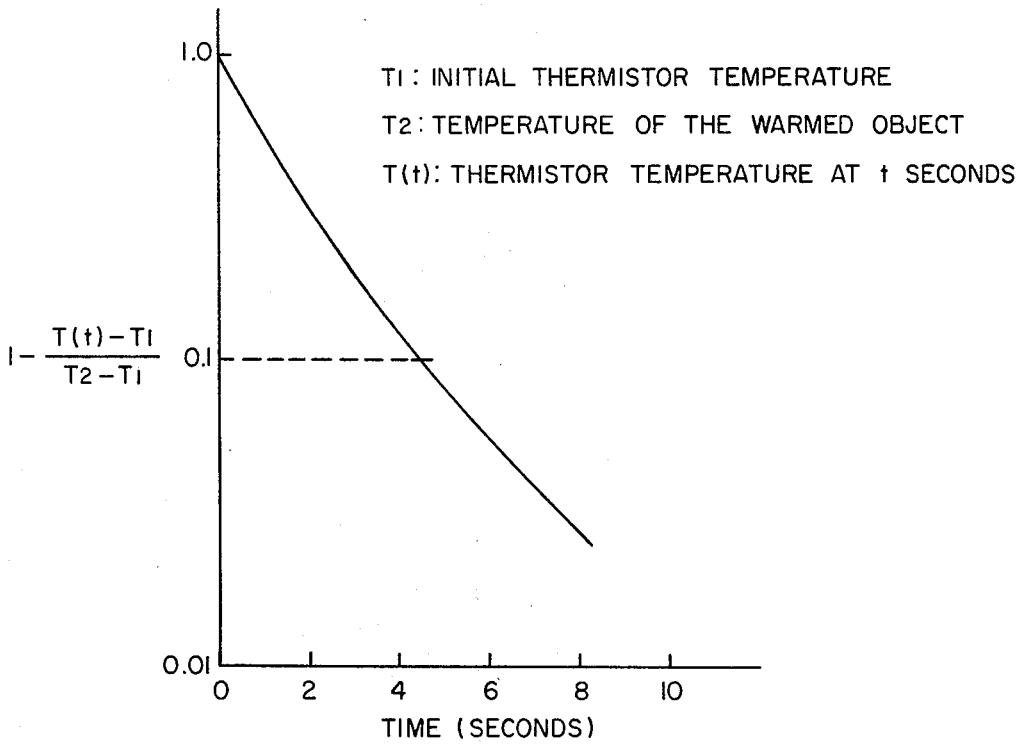
FIG. 3 shows a typical thermal response of a thin film thermistor embodying the present invention.

FIG. 3 shows a typical thermal response of the thin film thermistor according to the invention. The curve in FIG. 3 shows a time dependency of the thermistor temperature after the thermistor is kept initially at a certain temperature $T_1$° C. (20° C.) and then the outer surface 5*b* of the closed end 5 is mechanically and abruptly connected to the outer surface of the object being warmed at a temperature of $T_2$° C. (100° C.). The 90% response time is defined as the time which it takes for the thermistor temperature to reach $T_1+0.9(T_2-T_1)$°C. after the abrupt contact of the thermistor to the warmed object. In this measurement, heat capacity of the warmed object is arranged so that it is much larger than the heat capacity of the thermistor in order to prevent the temperature of the warmed object from varying due to the mechanical contact. In this experiment, a pan filled with about 1000 cc of warmed water was used as the warmed object. As shown in FIG. 3, the 90% response time is 4–5 sec. As described hereinbefore, the thin film thermistor according to the present invention has a rapid thermal response. This rapid thermal response is considered to be ascribed to a very low heat resistance between the thermistor element T and the metal housing 4. This low heat resistance is achieved by the construction of the thin brazing arrangement of about 60 μm in thickness.

The reason why the alumina substrate 1 is secured Ag-Cu eutectic alloy 6' as described above is not known in detail. However, it has been found that Ti or Zr atoms exist in a thin surface layer (about 1 μm in thickness) near the other surface 1*b* of the alumina substrate 1 by means of X-ray Micro-Analysis. On the other hand, the alumina substrate 1 can not be secured with the Ag-Cu eutectic alloy 6' if the Ti or Zr foil 7 is removed. These facts suggest that diffusion of Ti or Zr atoms during heating at 820° C. in a vacuum from the Ti or Zr foil 7 to the other surface 1*b* of the alumina substrate 1 determines the joint of the alumina substrate 1 to the Ag-Cu eutectic alloy 6'. Tensile strength of the brazed portion ranges from 100 to 500 g/mm$^2$. This range of values of the tensile strength is mechanically strong enough for practical uses.

In order to prevent the brazed portion between the insulating substrate 1 and the metal housing 4 from being cracked, it is preferable that the insulating substrate 1 and the metal housing 4 have similar thermal expansion characteristics. Since the thermal expansion coefficients of an insulating substrate 1 such as alumina, murite and the like generally range from $40\times10^{-7}$/°C. to $80\times10^{-7}$/°C., the metal housing 4 is composed preferably of a material selected from the group consisting Fe-Ni-Co alloy ($\sim55\times10^{-7}$/°C.), Fe-Cr alloy ($\sim110\times10^{-7}$/°C.) and Ti metal ($\sim80\times10^{-7}$/°C.).

The Ag-Cu eutectic alloy (Ag 73–71 wt%, Cu 27–29 wt%) having a melting point of about 790° C. is preferable as the Ag-Cu alloy 6, 6' because the Ag-Cu eutectic alloy is used widely in industrial uses in the form of a foil. The thin film thermistor according to the invention is constructed easily by means of heating the piled mass in an inert atmosphere in the order of the thermistor element T, the Ag-Cu eutectic alloy in the form of foil 6', the Ti or Zr foil 7, the Ag-Cu eutectic alloy in the form of foil 6 and the metal housing 4.

There are various thermally sensitive resistive films 3 comprising materials, such as those described hereinbefore. With respect to these materials, the SiC resistor film is found to be preferable as the thermally sensitive resistive film 3 because of its superior thermal stability and the unique temperature dependency of its resistance. When the thin film thermistor according to the present invention is used practically as a temperature sensing device for the purpose of controlling automatic cooking, the thermistor is required to be stable at high temperature of 350° C. and detect temperatures over a wide range of 30°–300° C. The thin film thermistors using a sputtered SiC resistive film 3 formed on one surface 1*a* of the alumina substrate 1 were examined at high temperature of 350° C. for 1000 hours. As a result, it was found that rates of variation in resistance were less than ±6%. This examination indicates an excellent thermal stability of the sputtered SiC resistive film 3. On the other hand, the sputtered SiC resistive film 3 has a unique characteristic in that the B constant increases linearly with an increase of temperature. The typical values of the B constant increased from 1950° K. at 323° K. (50° C.) to 3080° K. at 523° K. (250° C.). Owing to this unique characteristic, when the sputtered SiC resistive film 3 is used in a thermistor bridge, the temperature sensitivity of the thermistor bridge is less temperature dependent over a wide range of 30°–300° C. This fact means that the sputtered SiC resistive film 3 is suitable to detect temperatures over the wide temperature range described above.

In order to use the thin film thermistor practically, it is necessary to protect the thermistor element T from dust, moisture, organic gases and the like environments.

A further aspect of the invention resides in such a protecting arrangement.

Figure 4:
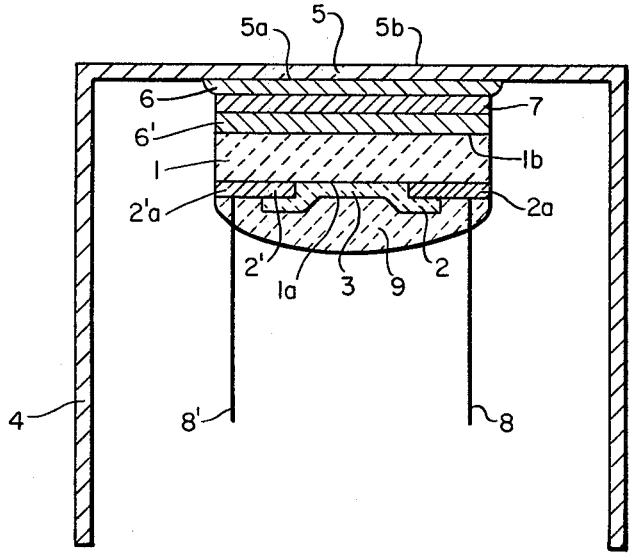
FIG. 4 is a cross-sectional view showing a construction of a thin film thermistor to the present invention wherein a protective layer of a fired low melting point glass is formed on one entire surface of the insulating substrate whereon the electrodes and thermally sensitive resistive film are formed.

The protecting arrangement suitable for the thermistor element T according to the present invention is shown in FIG. 4. A protective layer 9 of a fired low melting point glass is fixed on one entire surface 1*a* of the insulating substrate 1 whereon the electrode films 2, 2' and the resistive film 3 are formed. Since the protective layer 9 is an electrically insulating material, the thermistor element T can be protected from environments without varying the electrical characteristics thereof. Moreover, the connections of external leads 8, 8' with the electrode films 2, 2' are preferably reinformed by the protective layer 9. The tensile strength between external leads 8, 8' and the exposed portions 2*a*, 2'*a* of the electrode films 2, 2' is about 5 g at the welded portions and is rather poor. When the welded portions are covered with the protective mass 9, the tensile strength can be improved to a level of above 100 g. Preferably, the thermal expansion coefficient of the fired low melting point glass is in the range of from $40\times10^{-7}$/°C. to $60\times10^{-7}$/°C. in order to prevent the protective layer 9 of the fired low melting point glass from being cracked due to the same reasons as described hereinbefore.

The SiC thin film thermistors protected with the fired low melting point glass according to the present invention were examined under various conditions such as at a high temperature of 350° C. for 1000 hours, at a high humidity over 95 R.H.% at 70° C. for 1000 hours, in an atmosphere containing organic vapor such as of oils, and the like, under mechanical vibration and under heat shock of 1000 cycles, each cycle being conducted such that samples were held in water at room temperature for 15 minutes and then at 350° C. for 15 minutes in air. As a result, it was found that rates of variation in the resistance were less than ±6%, and little or no change was observed with respect to thermal response, insulating resistance, insulating voltage and the like. These results suggest that the thin film thermistor according to the present invention has a high reliability under severe conditions.

What is claimed is:

1. A thin film thermistor comprising:

an insulating substrate having two surfaces;

one pair of electroconductive electrode films arranged on one surface of said insulating substrate in a desired pattern, the electrodes being electrically insulated from each other;

a thermally sensitive resistive film arranged on said one surface of said insulating substrate and said at least one pair of electroconductive electrode films, said film arranged so as to leave part of said electrodes exposed for making external connections thereto;

one pair of external leads connected to said exposed electrode portions; and a metal housing in a cylindrical form having a bore extending along the longitudinal axis thereof and having both a closed end and an open end, wherein another surface of said insulating substrate is secured to the inner surface of said closed end by a brazing arrangement of an Ag-Cu alloy layer, one of a Ti and a Zr foil layer, and another Ag-Cu alloy layer, said layers arranged between said another surface of said insulating substrate and said inner surface of said closed end.

2. A thin film thermistor as claimed in claim 1, wherein said metal housing is composed of a material selected from the group comprising Fe-Ni-Co alloy, Fe-Cr alloy and Ti.

3. A thin film thermistor as claimed in claim 1 or 2, wherein said Ag-Cu alloy layer and said another Ag-Cu alloy layer comprise Ag-Cu eutectic alloy layers.

4. A thin film thermistor as claimed in claim 1 or 2, wherein said resistive film comprises a sputtered SiC resistive film.

5. A thin film thermistor as claimed in claim 1 or 2, further comprising a protective layer of a fired low melting point glass arranged over said entire one surface of said insulating substrate whereon said electroconductive electrodes and said resistive film are formed.

6. A thin film thermistor as claimed in claim 5, wherein the thermal expansion coefficient of said fired low melting point glass is in the range of from $40\times10^{-7}$/°C. to $60\times10^{-7}$/°C.

7. A thin film thermistor as claimed in claim 3, wherein said resistive film comprises a sputtered SiC resistive film.

8. A thin film thermistor as claimed in claim 7, further comprising a protective layer of a fired low melting point glass arranged over said entire one surface of said insulating substrate whereon said electroconductive electrodes and said resistive film are formed.

9. A thin film thermistor as claimed in claim 3, further comprising a protective layer of a fired low melting point glass arranged over said entire one surface of said insulating substrate whereon said electroconductive electrodes and said resistive film are formed.

10. A thin film thermistor as claimed in claim 4, further comprising a protective layer of a fired low melting point glass arranged over said entire one surface of said insulating substrate whereon said electroconductive electrodes and said resistive film are formed.

11. A thin film thermistor as claimed in claim 8, wherein the thermal expansion coefficient of said fired low melting point glass is in the range of from $40\times10^{-7}$/°C. to $60\times10^{-7}$/°C.

12. A thin film thermistor as claimed in claim 9, wherein the thermal expansion coefficient of said fired low melting point glass is in the range of from $40\times10^{-7}$/°C. to $60\times10^{-7}$/°C.

13. A thin film thermistor as claimed in claim 10, wherein the thermal expansion coefficient of said fired low melting point glass is in the range of from $40\times10^{-7}$/°C. to $60\times10^{-7}$/°C.

* * * * *